US005516204A

United States Patent [19]

Calvert et al.

[11] Patent Number: 5,516,204

[45] Date of Patent: May 14, 1996

[54] SLIDING AND SPILL PROOF CANTILEVER SHELF

[75] Inventors: Scott A. Calvert; Frank S. Pang; William J. Armstrong, all of Louisville, Ky.

[73] Assignee: General Electric Company, Louisville, Ky.

[21] Appl. No.: 272,948

[22] Filed: Jul. 11, 1994

Related U.S. Application Data

[63] Continuation of Ser. No. 997,577, Dec. 28, 1992, abandoned.

[51] Int. Cl.[6] ..... A47B 81/00

[52] U.S. Cl. ..... 312/408; 312/330.1; 312/334.27; 312/410

[58] Field of Search ..... 312/404, 408, 312/410, 330.1, 334.2, 270.3, 306, 350, 351

[56] References Cited

U.S. PATENT DOCUMENTS

| | | | |
|---|---|---|---|
| 2,276,942 | 3/1942 | Dibble | 312/408 X |
| 3,456,996 | 7/1969 | Heiniger-Schar | 312/330.1 X |
| 3,574,484 | 4/1971 | Kesling | 312/330.1 |
| 3,633,983 | 1/1972 | Whitcomb | 312/306 |
| 3,984,163 | 10/1976 | Boorman, Jr. et al. | 312/330.1 X |
| 4,936,641 | 6/1990 | Bussan et al. | 312/408 |
| 5,069,438 | 12/1991 | Urban et al. | 271/10 |
| 5,228,764 | 7/1993 | Cherry et al. | 312/408 |

FOREIGN PATENT DOCUMENTS

| | | |
|---|---|---|
| 0507455 | 7/1992 | European Pat. Off. . |
| 507455A2 | 7/1992 | European Pat. Off. . |
| 8535795 | 3/1986 | Germany . |

*Primary Examiner*—Peter Vo
*Assistant Examiner*—Khan V. Nguyen
*Attorney, Agent, or Firm*—H. Neil Houser

[57] ABSTRACT

A shelf assembly for a refrigerator with a pair of ladder tracks secured the rear wall of a storage compartment includes a pair of supports with bases secured to the tracks. Each shelf support includes a vertical wall extending forwardly from the track and a flange projecting inwardly of the vertical wall. A rectilinear shelf member has front, rear and side edges and a rim structure encapsulates the edges of the shelf and includes a pair of slide portions which are positioned below the side edges of the shelf member and are slidably supported on the flanges. Each flange includes a downwardly extending inner edge and each rim slide portion projects downwardly adjacent and then outwardly under the corresponding flange inner edge. The shelf member has a planar upper surface and the rim structure closely overlaps the shelf member edges to restrain flow of spilt liquid between the shelf member and the rim.

9 Claims, 2 Drawing Sheets

SLIDING AND SPILL PROOF CANTILEVER SHELF

This application is a continuation of application Ser. No. 07/997,577, filed Dec. 28, 1992, now abandoned.

BACKGROUND OF THE INVENTION

This invention relates to shelf assemblies for refrigerators and, more particularly, to such shelves which are flexible in use and economical in manufacture.

Modern refrigerators often include cantilevered shelves, that is the shelf structure is supported by support arms or beams which are mounted in a cantilever fashion from slotted brackets attached to the rear wall of the refrigerator. These brackets are sometimes called ladder treaks because they resemble ladders. However, while such cantilever support is vertically adjustable within the refrigerator, the shelf is not normally moveable upon the supports.

Often drawers and sometimes shelves are horizontally movable between an open position, partly out of the refrigerator, and a closed position, fully received in the refrigerator. However, normally such drawers are not vertically moveable within the refrigerator and such shelves are mounted with mechanisms that provide at most only limited vertical adjustability.

At one time some refrigerators included open wire shelf structures mounted on cantilever supports so as to be horizontally and vertically adjustable. However, such assemblies were expensive and lacked optimal multi-purpose use of certain components.

The present invention provides an improved shelf assembly which has a vertically adjustable mount and is movable in the horizontal direction for ease of loading and unloading while making economical use of its components.

SUMMARY OF THE INVENTION

In a refrigerator having a storage compartment with a pair of ladder tracks secured to the rear wall of the compartment in a spaced apart vertical orientation, there is provided a sliding, spill proof shelf assembly cantilever mounted to the tracks. The shelf assembly includes a pair of shelf supports, each of which has a base portion removably secured to a corresponding track for mounting of the supports at selected vertical positions within the compartment. Each support includes a generally vertically oriented wall extending forward of the base portion. An elongated flange projects inwardly from each wall toward the other wall so that the flanges are disposed in a spaced apart relationship within the compartment. Each flange includes a downwardly extending inner edge portion.

The assembly also includes a rectilinear imperforate shelf member with spaced apart front, rear and side edges. A rim structure encapsulates the shelf edges. Preferably the upper surface of the shelf member is planar and the rim structure closely overlies the upper surface to restrain flow of liquid between them and the rim structure projects above the upper shelf surface to contain a spill from running over the side of the shelf member.

The rim structure includes a pair of slide portions positioned below the shelf side edges and slidably supported on the support flanges. Each slide portion projects downwardly adjacent the inner edge of the corresponding flange and then projects outwardly below the flange edge. This aligns the shelf for straight sliding movement on the flanges and prevents the shelf from tilting when it is in an open position, not fully supported by the flanges.

DESCRIPTION OF THE PREFERRED EMBODIMENTS

Figure 1:
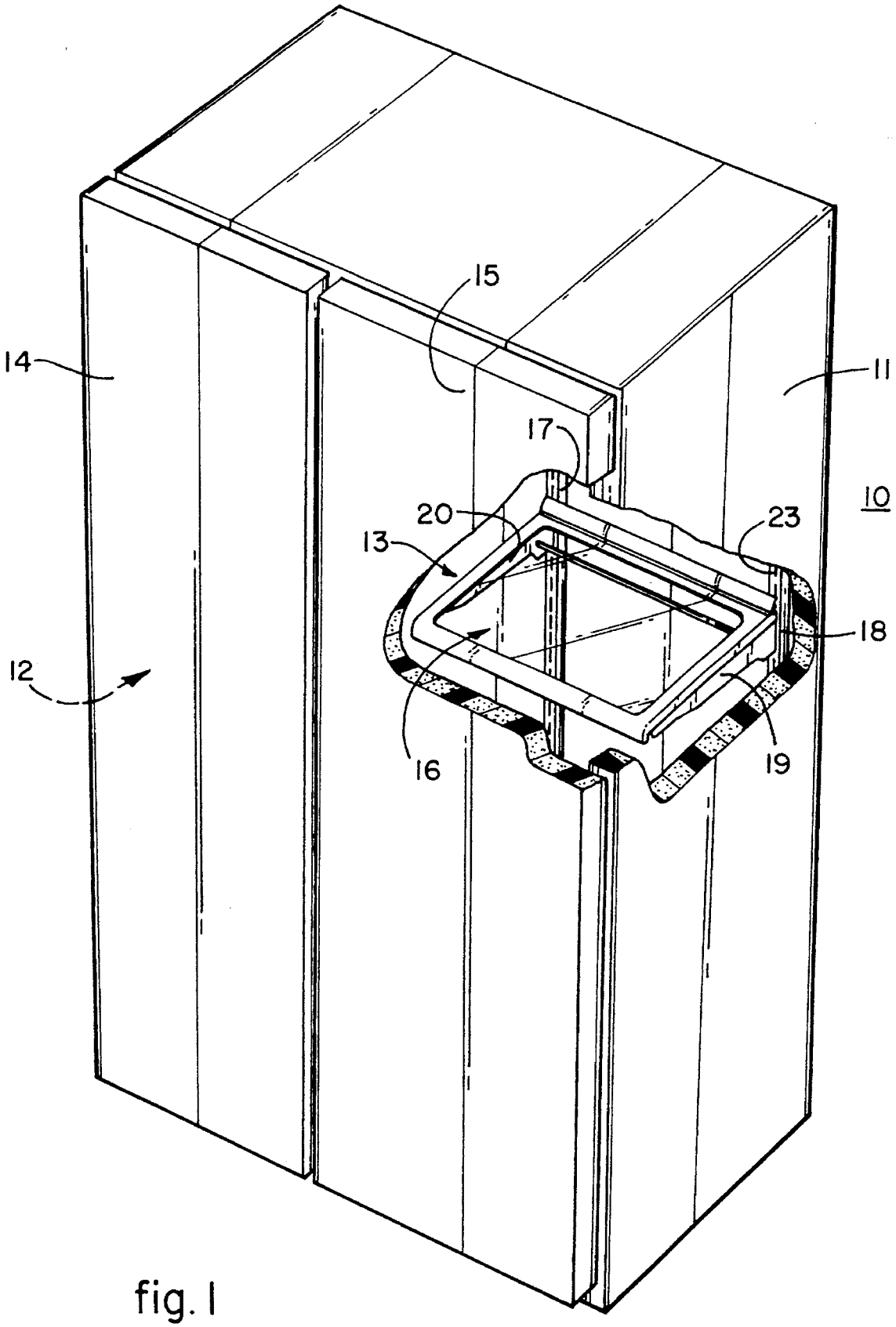
FIG. 1 is a simplified front perspective view of a side-by-side refrigerator with a shelf assembly incorporating one embodiment of the present invention.

Referring particularly to FIG. 1, there is shown a household refrigerator 10 of the side-by-side type; that is the cabinet 11 includes a freezer compartment 12 and a fresh food compartment 13 arranged in a side-by-side configuration. Each of the compartments has a front access opening which is normally closed by hinged doors 14 and 15 respectively. The particular refrigerator structure 10 is shown for illustrative purposes only, and it will become apparent as the description progresses that the present invention is equally useful with other types of refrigerators, such as, for example, top mount refrigerators in which the freezer compartment is positioned above the fresh food compartment. Various operating components refrigerators, such as the refrigeration system for example, are not involved with the present invention and have been omitted for the sake of simplicity.

Shelf assemblies, such as that illustrated at 16, are provided to support various items stored in either the fresh food storage compartment 13 or in the freezer compartment 12. In accordance with one embodiment of the present invention, the shelves are provided with flexibility of vertical positioning within the compartment by the use of a cantilever mounting including a pair of vertically elongated ladder tracks 17 and 18 which are mounted to the rear wall of the compartment in spaced apart relationship. A support structure including supports 19 and 20 is mounted to the ladder tracks in any one of numerous vertical positions along the tracks.

Figure 2:
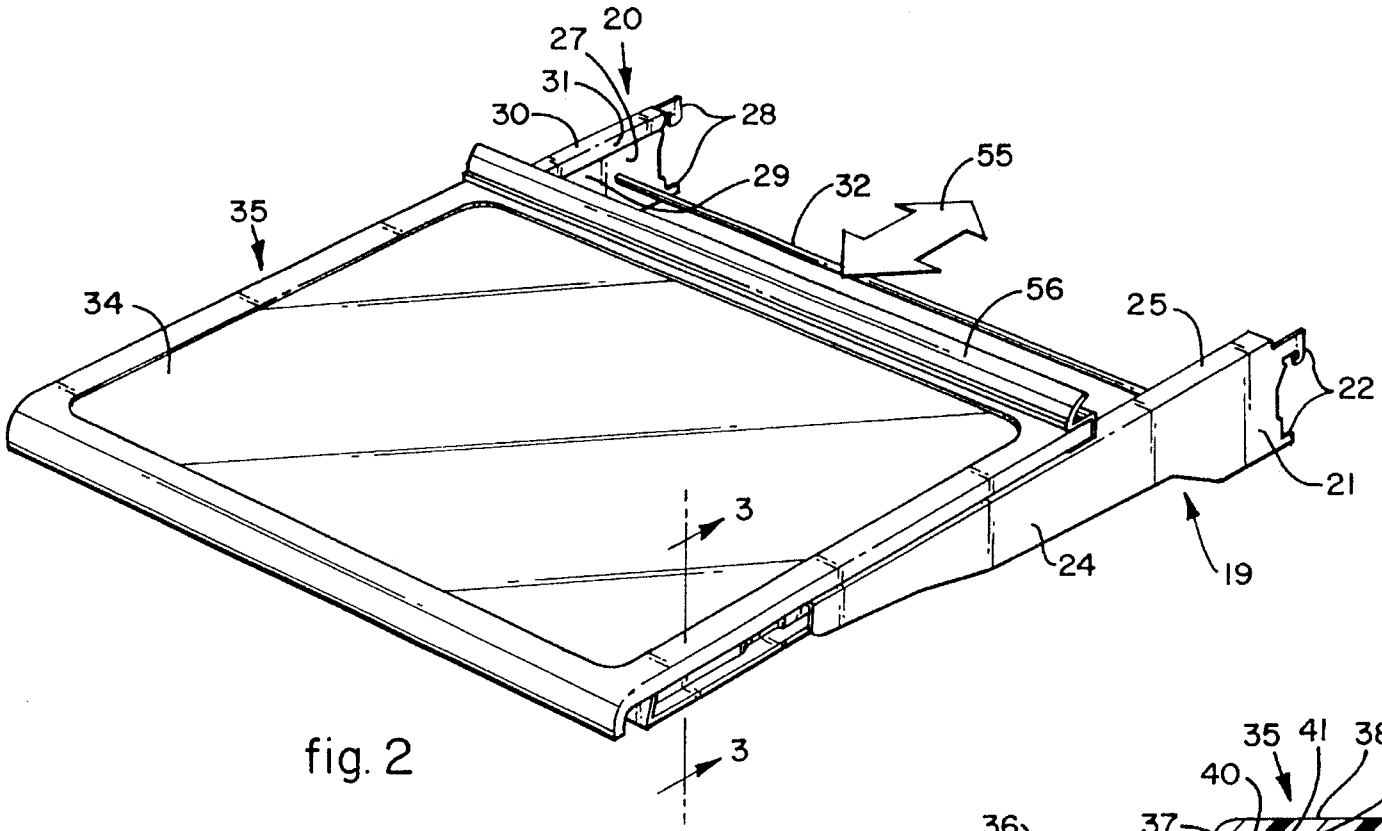
FIG. 2 is a perspective view of the shelf assembly illustrated in FIG. 1.

Referring more particularly to FIG. 2, the support 19 includes a base portion or section 21 with vertically spaced apart hooks 22 that are received in openings 23 in track 18 to mount the support to the track. A generally vertically oriented wall 24 extends forwardly from the base portion 21 and the upper portion of the wall 24 is bent over to form an elongated, horizontal flange 25 that extends along at least most of the length of the wall 24 and projects toward the support 20, The inner portion of the flange 25 is bent over to form a downwardly projecting edge portion 26 (see FIG. 3). The support 20 is a mirror image of the support 19, including base portion 27 with hooks 28, vertical wall portion 29, horizontal flange 30 and downwardly projecting edge portion 31. Spacers, one of which is shown at 32, are provided near the front and rear of the supports and secure them in a spaced apart relationship corresponding to the spacing between the tracks 17 and 18. The flages 25, 30 preferrably are formed by bending over the upper portion of walls 24, 29. However, it will be recognized that the flanges may be formed separately and then attached to the walls by welding, riveting or other means.

Figure 3:
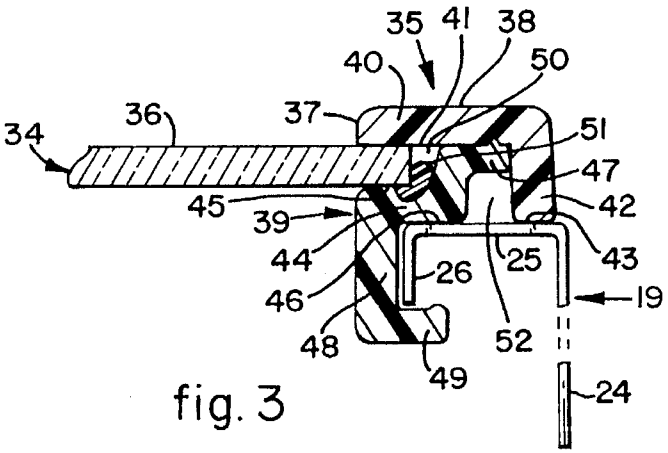
FIG. 3 is a fragmentary cross-sectional view of the edge portion of the shelf assembly of FIG. 2.

The assembly also includes a rectilinear, imperforate shelf member 34 which has spaced apart front, rear, and side edges. A rim structure 35 encapsulates the entire periphery of the shelf member. Referring particularly to FIG. 3, the shelf member 34 preferably includes a planar upper surface 36 and the rim structure closely overlies the upper surface to restrain any flow or seepage of liquid between the shelf member and the rim structure. In addition, the rim projects upwardly from the upper surface 36 around the entire periphery of the shelf member 34, as indicated at 37, to contain a spill on the shelf from running over the edge of the shelf.

The rim structure conveniently may be of a two part construction with an upper member 38 and a lower member 39 joined by sonic welding, gluing or other suitable means. The upper rim member 38 includes a main body portion 40 with a flat or planar under surface 41, that lays against the upper surface 36 of the shelf member, and a downwardly extending outer flange 42 with a lower surface 43 that rests on the support flange 25. The lower rim member 39 includes a main body portion 44 with an upper surface 45, that supports the under side the shelf member 34, and a lower surface 46, that rests on the flange 25. An upwardly offset tang 47 abuts against the under side 41 of the upper rim member and preferably is sonic welded thereto. An inner flange 48 projects downwardly from the lower main body 44 adjacent the inner edge 26 of flange 25 and terminates in a foot 49, which projects outwardly under the edge portion 26. Thus the rim structure forms a slide portion which supports the edge of the shelf member, slides on the flange 25 and fits around the inner edge 26 of the flange.

The rim structure forms an internal recess 50 which extends around the entire periphery of the shelf member and a continuous bead 51 of sealant, such as silicone for example, is placed in the recess to further restrain any liquid flow or seepage between the shelf member and the rim structure. The tang is illustrated as having a thin cross section, which forms a recess 52 above the flange 25 between lower main body 44 and upper flange 42. This is to conserve material and simplify the mold operations. If desired, the configuration of either of the rim members may be modified to eliminate this recess.

The other side of the rim structure is a mirror image of that shown in FIG. 3 in order to inter act with the shelf member 34 and support 20. Conveniently each of the rim members may be molded as one continuous piece with an uniform cross section. Alternatively, if desired, the front and rear portions of the rim members may have different cross sections. For example, the flange 48 and foot 49 may be omitted entirely from the rear portion of lower rim member 39 as there is no support flange for them to cooperate with. Similarly the flange 48 and foot 49 along the front of the shelf may be replaced with an integrally formed handle for sliding the shelf assembly in to and out of the compartment.

As previously described, the slide portions formed on the sides of the rim structure cooperate with the flanges to provide sliding movement of the shelf member along the flanges into and out of the compartment as indicated by arrow 55 in FIG. 2. At the same time the downwardly projecting flanges 48 and outwardly projecting feet 49 cooperate with the inner edges 26, 31 of flanges 25, 30 to assure that the shelf member and rim structure are properly aligned for non-binding sliding movement and to assure that the shelf member does not tilt or rotate about the supports when the shelf member is pulled out of the refrigerator. Smooth sliding movement of the shelf member on the support flanges is enhanced by molding at least the lower rim member 39 from a suitable plastic material with an integral lubricant, such as a 2% silicone, Poly-Acrylonitrile, Butadiene, styrene (ABS) blend.

If desired, a guard 56 may be provided along the rear edge of the shelf member 34 to prevent items from falling off the rear of the shelf, particularly as it is moved on supports 19, 20. The illustrative guard 56 is a separate molded plastic piece which snap fits over the rear edge of shelf member 34. However, it will be understood that other guard constructions may be employed. For example, the guard could be integrally molded with the upper rim member 35.

What is claimed and desired to be secured by Letters Patent is:

1. In a refrigerator having a storage compartment with a rear wall and a pair of elongated ladder tracks secured to the rear wall in a spaced apart vertical orientation; a shelf assembly including:

a pair of shelf supports, each of said supports including a base portion removably secured to a corresponding one of the ladder tracks, a generally vertically oriented wall extending forwardly of said base portion within the compartment and a flange projecting generally horizontally inward of said vertical wall, so that said shelf support flanges are disposed in a spaced apart relationship within the compartment;

a rectilinear imperforate shelf member with an upper surface, an under side and spaced apart front, rear and side edges;

a rim structure encapsulating said shelf edges;

said rim structure comprising an upper member and a lower member joined together around said edges of said shelf member;

said upper rim member including a main body portion engaging the upper surface of said shelf member along said shelf side edges;

said lower rim member including a main body portion supporting said under side of said shelf member along said shelf side edges and resting on each of said horizontally projecting support flanges and including a flange projecting downwardly inside each of said horizontally projecting support flanges to assure non-binding sliding movement of said shelf on said supports; and each of said support flanges including a downwardly extending inner edge portion and said lower rim member flange projecting downwardly adjacent said inner edge portion to maintain said shelf aligned on said shelf supports.

2. A shelf assembly as set forth in claim 1, wherein: said lower rim member flange also projects outwardly below each of said support flanges for restraining said shelf member from vertical movement relative to said shelf supports.

3. A shelf assembly as set forth in claim 1, wherein: said lower rim member flange also projects outwardly below said flange inner edge portion to restrain said shelf from vertical movement relative to said shelf supports.

4. A shelf assembly as set forth in claim 1, wherein: at least said lower rim member is formed of a plastic material with an integral lubricant to assist sliding of said shelf on said flanges.

5. A shelf assembly as set forth in claim 1, wherein: said shelf upper surface is planar and said upper rim member main body portion closely overlies said shelf member upper surface to restrain any flow of liquid between said shelf member and said rim structure.

6. A shelf assembly as set forth in claim 1, wherein: said upper rim member main body portion projects upwardly from said shelf member upper surface to thereby contain a spill from running over the edges of said shelf.

7. A shelf assembly as set forth in claim 1, further including: restraining means extending across said shelf assembly above said rear edge of said shelf member to restrain items from falling off said shelf member as it is moved.

8. A shelf assembly as set forth in claim 1, wherein:

said upper and lower rim members are joined together and form a recess within said rim structure extending around said shelf member outside said front, rear and side edges of said shelf member, and a sealant material is received within said recess to further restrain flow of liquid between said shelf member and said rim structure.

9. A shelf assembly as set forth in claim 1, wherein: said shelf supports and said rim structure are constructed and arranged to permit sliding motion of said shelf member, maintain said shelf member in alignment with said shelf supports and prevent tilting of said shelf member relative to said supports.

* * * * *